US010089968B1

(12) United States Patent
Valdez

(10) Patent No.: US 10,089,968 B1
(45) Date of Patent: Oct. 2, 2018

(54) DRUM MUFFLE SYSTEM

(71) Applicant: John Valdez, Cibolo, TX (US)

(72) Inventor: John Valdez, Cibolo, TX (US)

( * ) Notice: Subject to any disclaimer, the term of this patent is extended or adjusted under 35 U.S.C. 154(b) by 0 days.

(21) Appl. No.: 15/602,264

(22) Filed: May 23, 2017

(51) Int. Cl.
*G10D 13/02* (2006.01)

(52) U.S. Cl.
CPC ..... *G10D 13/022* (2013.01)

(58) Field of Classification Search
CPC ..... G10D 13/022
See application file for complete search history.

(56) References Cited

U.S. PATENT DOCUMENTS

| | | | | | |
|---|---|---|---|---|---|
| 2,499,616 | A * | 3/1950 | Walberg | G10D 13/022 | 84/411 R |
| 2,572,504 | A * | 10/1951 | Meriwether | G10D 13/022 | 84/411 R |
| D225,928 | S | 1/1973 | Lockwood | | |
| 4,244,266 | A | 1/1981 | Hardy | | |
| 4,519,288 | A | 5/1985 | Aluisi | | |
| 5,088,376 | A * | 2/1992 | Crago | G10D 13/022 | 84/411 M |
| 5,107,741 | A * | 4/1992 | Beals | G10D 13/022 | 84/411 M |
| 5,233,898 | A * | 8/1993 | Montano | G10D 13/022 | 181/207 |
| 5,574,236 | A * | 11/1996 | Webber | G10D 13/022 | 84/411 M |
| 5,587,543 | A * | 12/1996 | Da Silva Marques | G10D 13/022 | 84/411 M |
| 6,307,133 | B1 * | 10/2001 | May | G10D 13/022 | 181/161 |
| 6,573,441 | B2 * | 6/2003 | Norris, Jr. | G10D 13/022 | 84/411 M |
| 7,470,846 | B2 | 12/2008 | May | | |
| 2008/0148921 | A1 * | 6/2008 | Calder | G10D 13/022 | 84/411 M |
| 2015/0364119 | A1 | 12/2015 | Vermillion | | |

FOREIGN PATENT DOCUMENTS

| | | |
|---|---|---|
| WO | WO2016038408 | 3/2016 |

* cited by examiner

*Primary Examiner* — Robert W Horn

(57) ABSTRACT

A drum muffle system for muffling a bass drum includes a bass drum that has a first head and a second head. Each of the first and second heads has an inwardly facing surface. A pair of muffles is provided and each of the muffles is positioned within the bass drum. Each of the muffles frictionally engages the inwardly facing surface corresponding to an associated one of the first and second heads. In this way each of the muffles reduces vibration of the associated first and second head to reduce overtones from each of the first and second heads. A plurality of members is provided and each of the members is removably positioned between the muffles such that the muffles are retained against the associated first and second heads.

8 Claims, 3 Drawing Sheets

DRUM MUFFLE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to muffle devices and more particularly pertains to a new muffle device for muffling a bass drum.

BRIEF SUMMARY OF THE INVENTION

An embodiment of the disclosure meets the needs presented above by generally comprising a bass drum that has a first head and a second head. Each of the first and second heads has an inwardly facing surface. A pair of muffles is provided and each of the muffles is positioned within the bass drum. Each of the muffles frictionally engages the inwardly facing surface corresponding to an associated one of the first and second heads. In this way each of the muffles reduces vibration of the associated first and second head to reduce overtones from each of the first and second heads. A plurality of members is provided and each of the members is removably positioned between the muffles such that the muffles are retained against the associated first and second heads.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
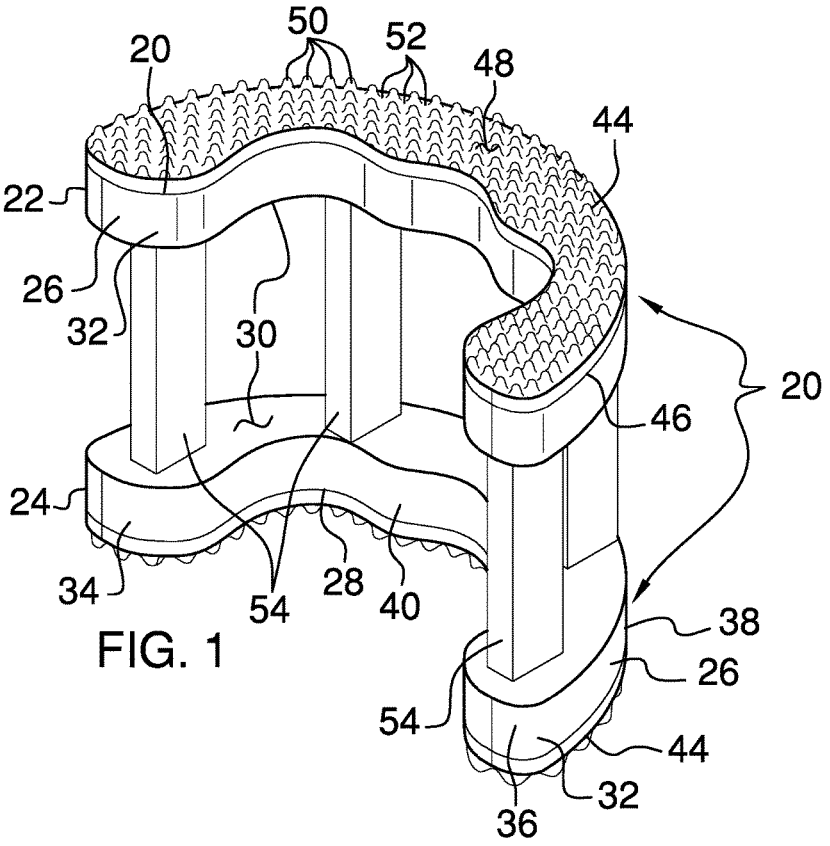
FIG. 1 is a perspective view of a drum muffle system according to an embodiment of the disclosure.
Figure 2:
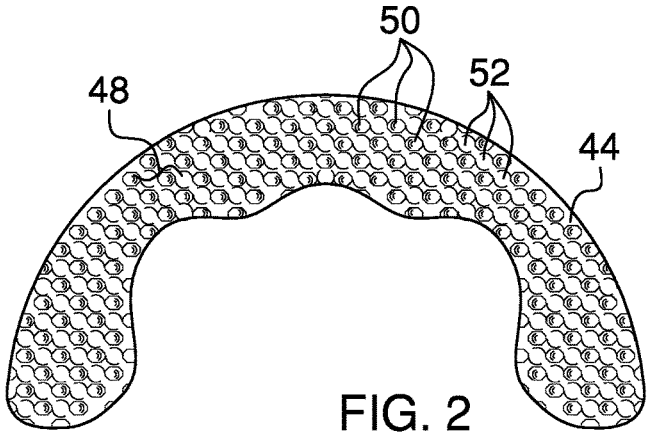
FIG. 2 is a front view of muffle of an embodiment of the disclosure.
Figure 3:
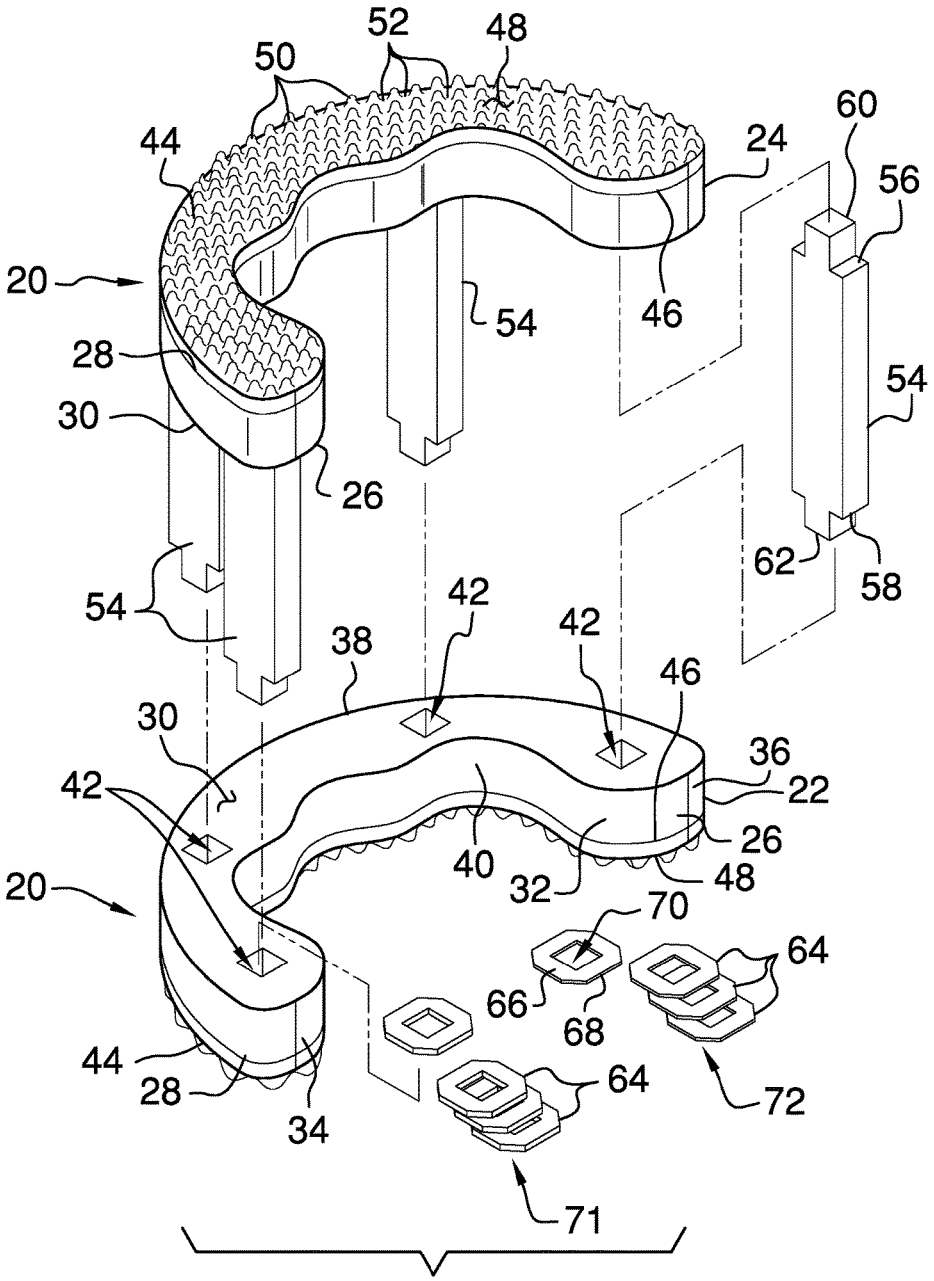
FIG. 3 is an exploded view a pair of muffles, a plurality of members and a plurality of spacers of an embodiment of the disclosure.
Figure 4:
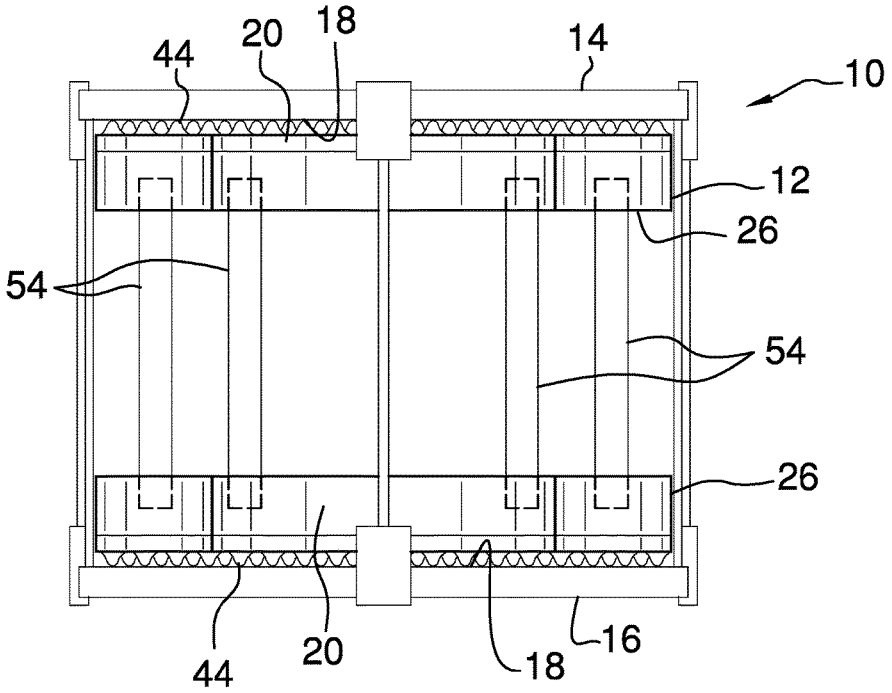
FIG. 4 is a top phantom view of an embodiment of the disclosure.
Figure 5:
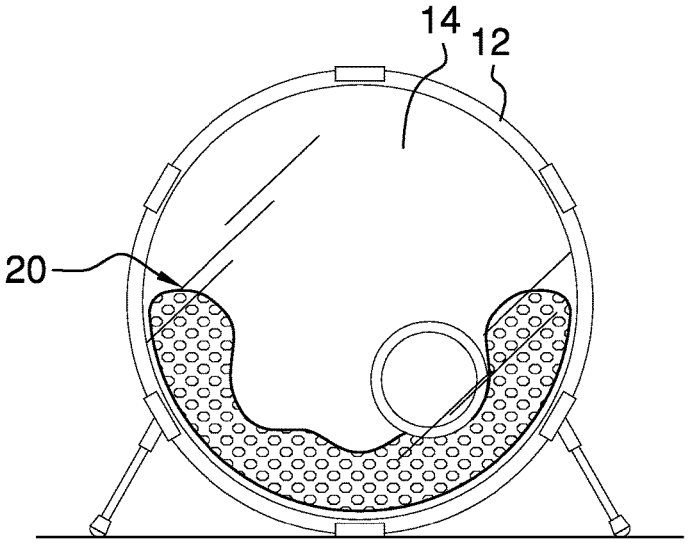
FIG. 5 is a perspective in-use view of an embodiment of the disclosure.

With reference now to the drawings, and in particular to FIGS. 1 through 5 thereof, a new muffle device embodying the principles and concepts of an embodiment of the disclosure and generally designated by the reference numeral 10 will be described.

As best illustrated in FIGS. 1 through 5, the drum muffle system 10 generally comprises a bass drum 12 that has a first head 14 and a second head 16. Each of the first 14 and second 16 heads has an inwardly facing surface 18. The bass drum 12 may be an acoustic bass drum 12 of any conventional design. A pair of muffles 20 is provided and each of the muffles 20 is positioned within the bass drum 12. Each of the muffles 20 frictionally engages the inwardly facing surface 18 corresponding to an associated one of the first 14 and second 16 heads. In this way each of the muffles 20 reduces vibration of the associated first and second head 16 to reduce overtones from each of the first 14 and second 16 heads. The pair of muffles 20 includes a first muffle 22 and a second muffle 24.

Each of the pair of muffles 20 comprises a pad 26 that has a first surface 28, a second surface 30 and a peripheral edge 32 extending therebetween. The peripheral edge 32 has a first end 34, a second end 36, a first lateral side 38 and a second lateral side 40. Each of the first 38 and second 40 lateral sides is concavely arcuate between the first 34 and second 36 ends. Thus, each of the muffles 20 has a semi-circular shape to conform to a curvature of the bass drum 12. Additionally, the semi-circular shape of the muffles 20 facilitates each of the muffles 20 to be positioned within said bass drum 12 without engaging a microphone or other object that is positioned within the bass drum 12.

The second lateral side 40 undulates between the first 34 and second 36 ends. The second surface 30 has a plurality of wells 42 extending toward the first surface 28. Moreover, the wells 42 are spaced apart from each other and are distributed between the first end 34 and the second end 36. The pad 26 may be comprised of a resiliently compressible material such as foam rubber or the like.

A cushion 44 is provided that has a primary surface 46 and a secondary surface 48. The primary surface 46 is coupled to the first surface 28 of the pad 26 and the cushion 44 completely covers the first surface 28 of the pad 26. The secondary surface 48 comprises an alternating sequence of peaks 50 and valleys 52 and the cushion 44 may be comprised of a resiliently compressible material such as foam rubber or the like. Additionally, the pad 26 has a density that is greater than a density of the cushion 44. Each of the muffles 20 is oriented having the secondary surface 48 of the cushion 44 corresponding to each of the muffles 20 frictionally engaging the inwardly facing surface 18 of the corresponding first and second head 16*s*. Additionally, the second surface 30 corresponding to each of the muffles 20 is directed toward each other.

A plurality of members 54 is provided and each of the members 54 is removably positioned between the muffles 20 such that the muffles 20 are retained against the associated first 14 and second 16 heads. Each of the members 54 has a first end 56 and a second end 58 and each of the members 54 is elongated between the first 56 and second 58 ends. Each of the members 54 has a first tab 60 extending away from the first end 34 and each of the members 54 has a second tab 62 extending away form the second end 36. The first tab 60 on each of the members 54 is inserted into an associated one of the wells 42 on the first muffle 22. The second tab 62 on each of the members 54 is inserted into an associated one of the wells 42 on the second muffle 24. In this way each of the first 22 and second 24 muffles is retained against the associated first 14 and second 16 heads.

A plurality of spacers 64 is provided and each of the spacers 64 is selectively positioned between the members 54 and the first 22 and second 24 muffles. In this way a distance between the first 22 and second 24 muffles is selectively increased. Thus, the plurality of spacers 64 selectively increases a pressure exerted against each of the first 14 and second 16 heads. In this way the plurality of spacers 64 selectively reduces vibration of the first 14 and second 16 heads.

Each of the spacers 64 has a first side 66 and a second side 68 and each of the spacers 64 has an aperture 70 extending through the first and second side 68*s*. The first tab 60 on each of the members 54 is selectively extended through the aperture 70 of a selected number of the spacers 64 when the first tab 60 is inserted into the associated well. The plurality of spacers 64 may include a first set of spacers 71 and a second set of spacers 72. Each of the first set of spacers 71 may have a thickness ranging between approximately 6.0 mm and 8.0 mm. Each of the second set of spacers 72 may have a thickness ranging between approximately 3.0 mm and 5.0 mm.

In use, each of the first 14 and second 16 heads is removed from the bass drum 12. Each of the members 54 is coupled between the first 22 and second 24 muffles. Additionally, a selected number of the first set 71 and the second set 72 of spacers are positioned between the members 54 and the muffles 20. In this way the pressure exerted on each of the first 14 and second 16 heads is selectively increased to increase dampening of each of the first 14 and second 16 heads. Each of the muffles 20 and the members 54 are positioned inside the bass drum 12 and each of the first 14 and second 16 heads is installed on the bass drum 12. Thus, the secondary surface 48 of the cushion 44 corresponding to each of the muffles 20 frictionally engages the associated first 14 and second 16 heads.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A drum muffle system comprising:

a bass drum having a first head and a second head, each of said first and second heads having an inwardly facing surface; and a pair of muffles, each of said muffles being positioned within said bass drum, each of said muffles frictionally engaging said inwardly facing surface corresponding to an associated one of said first and second heads such that each of said muffles reduces vibration of said associated first and second head wherein each of said muffles is configured to reduce overtones from each of said first and second heads, said pair of muffles including a first muffle and a second muffle;

a plurality of members, each of said members being removably positioned between said muffles such that said muffles are retained against said associated first and second heads; and each of said pair of muffles comprises a pad having a first surface, a second surface and a peripheral edge extending therebetween, said peripheral edge having a first end, a second end, a first lateral side and a second lateral side, each of said first and second lateral sides being concavely arcuate between said first and second ends, said second lateral side undulating between said first and second ends.

2. The assembly according to claim 1, wherein said second surface has a plurality of wells extending toward said first surface, said wells being spaced apart from each other and being distributed between said first end and said second end.

3. The assembly according to claim 1, further comprising a cushion having a primary surface and a secondary surface, said primary surface being coupled to said first surface having said cushion completely covering said first surface, said secondary surface comprising an alternating sequence of peaks and valleys.

4. The assembly according to claim 3, wherein each of said muffles is oriented having said secondary surface of said cushion corresponding to each of said muffles frictionally engaging said inwardly facing surface of said corresponding first and second heads and having said second surface corresponding to each of said muffles being directed toward each other.

5. The assembly according to claim 2, wherein each of said members has a first end and a second end, each of said members having a first tab extending away from said first end, each of said members having a second tab extending away form said second end, said first tab on each of said members being inserted into an associated one of said wells on said first muffle, said second tab on each of said members being inserted into an associated one of said wells on said second muffle such that each of said first and second muffles is retained against said associated first and second heads.

6. A drum muffle system comprising:

a bass drum having a first head and a second head, each of said first and second heads having an inwardly facing surface; and a pair of muffles, each of said muffles being positioned within said bass drum, each of said muffles frictionally engaging said inwardly facing surface corresponding to an associated one of said first and second heads such that each of said muffles reduces vibration of said associated first and second head wherein each of said muffles is configured to reduce overtones from each of said first and second heads, said pair of muffles including a first muffle and a second muffle;

a plurality of members, each of said members being removably positioned between said muffles such that said muffles are retained against said associated first and second heads; and a plurality of spacers, each of said spacers being selectively positioned between said members and said first and second muffles thereby increasing a distance between said first and second muffles, each of said spacers increasing a pressure exerted against each of said first and second heads wherein said plurality of spacers is configured to selectively reduce vibration of said first and second heads.

7. The assembly according to claim 6, wherein:

each of said members has a first tab;

each of said muffle has a plurality of wells; and each of said spacers has a first side and a second side, each of said spacers having an aperture extending through said first and second sides, said first tab on each of said members being selectively extended through said aperture of a selected number of said spacers when said first tab is inserted into said associated well.

8. A drum muffle system comprising:

a bass drum having a first head and a second head, each of said first and second heads having an inwardly facing surface; and a pair of muffles, each of said muffles being positioned within said bass drum, each of said muffles frictionally engaging said inwardly facing surface corresponding to an associated one of said first and second heads such that each of said muffles reduces vibration of said associated first and second head wherein each of said muffles is configured to reduce overtones from each of said first and second heads, said pair of muffles including a first muffle and a second muffle, each of said pair of muffles comprising:

a pad having a first surface, a second surface and a peripheral edge extending therebetween, said peripheral edge having a first end, a second end, a first lateral side and a second lateral side, each of said first and second lateral sides being concavely arcuate between said first and second ends, said second lateral side undulating between said first and second ends, said second surface having a plurality of wells extending toward said first surface, said wells being spaced apart from each other and being distributed between said first end and said second end, and a cushion having a primary surface and a secondary surface, said primary surface being coupled to said first surface having said cushion completely covering said first surface, said secondary surface comprising an alternating sequence of peaks and valleys, each of said muffles being oriented having said secondary surface of said cushion corresponding to each of said muffles frictionally engaging said inwardly facing surface of said corresponding first and second heads and having said second surface corresponding to each of said muffles being directed toward each other;

a plurality of members, each of said members being removably positioned between said muffles such that said muffles are retained against said associated first and second heads, each of said members having a first end and a second end, each of said members having a first tab extending away from said first end, each of said members having a second tab extending away form said second end, said first tab on each of said members being inserted into an associated one of said wells on said first muffle, said second tab on each of said members being inserted into an associated one of said wells on said second muffle such that each of said first and second muffles is retained against said associated first and second heads; and a plurality of spacers, each of said spacers being selectively positioned between said members and said first and second muffles thereby increasing a distance between said first and second muffles, each of said spacers increasing a pressure exerted against each of said first and second heads wherein said plurality of spacers is configured to selectively reduce vibration of said first and second heads, each of said spacers having a first side and a second side, each of said spacers having an aperture extending through said first and second sides, said first tab on each of said members being selectively extended through said aperture of a selected number of said spacers when said first tab is inserted into said associated well.

* * * * *